US008671589B2

(12) United States Patent
Bond et al.

(10) Patent No.: US 8,671,589 B2
(45) Date of Patent: Mar. 18, 2014

(54) SHOE SOLE HAVING FORWARDLY AND REARWARDLY FACING PROTRUSIONS

(75) Inventors: David Bond, Newbury Park, CA (US); Brian Keating, West Hills, CA (US)

(73) Assignee: K-Swiss, Inc., Westlake Village, CA (US)

( * ) Notice: Subject to any disclaimer, the term of this patent is extended or adjusted under 35 U.S.C. 154(b) by 450 days.

(21) Appl. No.: 12/945,237

(22) Filed: Nov. 12, 2010

(65) Prior Publication Data

US 2011/0167672 A1 Jul. 14, 2011

Related U.S. Application Data

(60) Provisional application No. 61/289,134, filed on Dec. 22, 2009.

(51) Int. Cl.
*A43B 5/00* (2006.01)
*A43B 21/26* (2006.01)

(52) U.S. Cl.
USPC ..... 36/28; 36/59 C; 36/114; 36/59 R

(58) Field of Classification Search
USPC ..... 36/59 C, 114, 59 R; D2/902, 951
See application file for complete search history.

(56) References Cited

U.S. PATENT DOCUMENTS

| | | | | | |
|---|---|---|---|---|---|
| 583,641 | A | * | 6/1897 | Brown | 36/32 R |
| 2,710,461 | A | | 6/1955 | Hack | |
| 2,930,149 | A | * | 3/1960 | Hack et al. | 36/28 |
| D190,162 | S | * | 4/1961 | Hubbard | D2/960 |
| 3,018,571 | A | * | 1/1962 | Doherty | 36/59 C |
| D203,577 | S | * | 2/1966 | Weinberg | D2/957 |
| 3,507,059 | A | * | 4/1970 | Vietas | 36/59 R |
| 3,717,943 | A | | 2/1973 | Orndorff, Jr. | |
| 3,947,979 | A | | 4/1976 | Sidles | |
| 3,961,428 | A | | 6/1976 | Sidles | |
| 4,045,888 | A | * | 9/1977 | Oxenberg | 36/114 |
| 4,060,917 | A | * | 12/1977 | Canale | 36/59 C |
| 4,067,123 | A | * | 1/1978 | Minihane | 36/32 R |
| 4,309,831 | A | * | 1/1982 | Pritt | 36/3 B |
| D269,139 | S | * | 5/1983 | Stubblefield | D2/957 |
| 4,569,142 | A | * | 2/1986 | Askinasi | 36/134 |
| 4,897,936 | A | | 2/1990 | Fuerst | |
| 5,524,364 | A | * | 6/1996 | Cole et al. | 36/29 |
| 5,918,385 | A | * | 7/1999 | Sessa | 36/59 C |

(Continued)

FOREIGN PATENT DOCUMENTS

| | | |
|---|---|---|
| WO | 92/14373 | 9/1992 |
| WO | WO 2005/037004 A1 | 4/2005 |

OTHER PUBLICATIONS

U.S. Appl. No. 12/790,386, filed May 28, 2010, Keating, et al.

(Continued)

*Primary Examiner* — Khoa Huynh
*Assistant Examiner* — Katharine Gracz
(74) *Attorney, Agent, or Firm* — Rothwell, Figg, Ernst & Manbeck, P.C.

(57) ABSTRACT

A shoe sole structure includes a plurality of downwardly extending protrusions arranged transverse to the longitudinal axis of the shoe and extending at least partially between a lateral edge and a medial edge of the shoe sole. The protrusions arranged in the heel region of the sole are angled forwardly and the protrusions arranged in the forefoot region are angled rearwardly.

16 Claims, 4 Drawing Sheets

(56) References Cited

U.S. PATENT DOCUMENTS

| | | | | |
|---|---|---|---|---|
| D413,012 | S * | 8/1999 | Challant | D2/960 |
| D416,669 | S * | 11/1999 | Parr et al. | D2/954 |
| 7,047,672 | B2 | 5/2006 | Hoffer et al. | |
| D529,693 | S * | 10/2006 | Le | D2/957 |
| 7,174,659 | B2 | 2/2007 | Delgorgue | |
| 7,204,044 | B2 | 4/2007 | Hoffer et al. | |
| 7,225,564 | B1 | 6/2007 | Gillespie | |
| 7,287,343 | B2 | 10/2007 | Healy | |
| 7,383,647 | B2 | 6/2008 | Chan et al. | |
| D593,742 | S | 6/2009 | Issler | |
| 2002/0166263 | A1 * | 11/2002 | Sink | 36/127 |
| 2005/0257402 | A1 * | 11/2005 | Kobayashi | 36/59 R |
| 2007/0199211 | A1 * | 8/2007 | Campbell | 36/59 R |
| 2008/0209766 | A1 | 9/2008 | Braunschweiler | |
| 2009/0293309 | A1 | 12/2009 | Keating et al. | |

OTHER PUBLICATIONS

Search Report issued Apr. 14, 2011 in United Kingdom Patent Application No. GB1021135.7.

* cited by examiner

SHOE SOLE HAVING FORWARDLY AND REARWARDLY FACING PROTRUSIONS

CROSS REFERENCE

This application claims priority under 35 U.S.C. §119(e) that claims the benefit of U.S. Provisional Application No. 61/289,134, filed Dec. 22, 2009, the entire contents of which are herein incorporated by reference.

BACKGROUND OF THE INVENTION

1. Field of the Invention

This invention relates to shoes designed to minimize impact shock and to increase stability and support.

2. Description of the Related Art

The athletic shoe is a combination of elements, which cooperatively interact in an effort to minimize weight and maximize comfort, cushioning, stability and durability. When running and walking, generally the foot makes initial contact with the ground at a force of 2.5 times their body weight, which may be repeated many times per minute per foot. The cushioning in most athletic shoes is supplied through the foam midsole that can be made from ethylene vinyl acetate (EVA) or polyurethane.

Shoes in the related art have included thicker midsoles to provide more cushioning ability. However, added thickness of foam in the midsole can cause the midsole to have increased stiffness in bending. Under these conditions, the lateral corner of the sole can tend to operate as a fulcrum upon heel strike and create an extended lever arm and greater moment, which can cause the foot to rotate medially and pronate with greater velocity than desired. This can lead to over-pronation of the foot and possible injury. Further, this condition can present a potentially unstable condition for the foot and result in the transmission of higher than desired levels of impact stress due to the relatively small surface area of contact.

It is an object of the present invention to provide a sole for an article of footwear that reduces or overcomes some or all of the deficiencies inherent in prior known footwear. Particular objects and advantages of the invention will be apparent to those skilled in the art, that is, those who are knowledgeable or experienced in this field of technology, in view of the following disclosure of the invention and detailed description of certain preferred embodiments.

SUMMARY OF THE INVENTION

According to an aspect of the invention, it has been recognized that prior shoe designs suffer from one or more disadvantages. The present invention relates to improved shoes that address the competing concerns of cushioning and stability with the ground support phase of running and walking in both the heel strike area and the forefoot area. More specifically, an example pertains to athletic shoe constructions designed to attenuate applied force and shock, and to provide support and stability during running and walking.

A shoe according to an example of the invention provides improved shock absorption upon heel strike without relying on soft midsoles to obtain the needed shock absorption during both the initial heel impact and the forefoot impact during running and walking.

According to an improvement, the sole of a shoe includes one or more protrusions or blades, extending transverse to the longitudinal axis of the shoe. In an example, one or more blades can extend substantially perpendicular to a longitudinal axis of the shoe. In a further example, one or more blades can extend at an angle with respect to the longitudinal axis of the shoe.

In an embodiment of the invention, one or more blades are located in a forward forefoot region of the shoe and/or in a rearward heel region of the shoe.

In a further example of the invention, the one or more blades located in the forefoot region are separated from the blades located in the rearward heel region by middle region that includes blade like protrusions that intersect each other at an angle.

In an example of the invention, the one or more blades extend at least substantially between a lateral side of the shoe to a medial side of the shoe. In an exemplary embodiment, one or more blades extend at least substantially across the shoe while other blades extend a distance less than the complete distance.

In one or more examples of the invention, a first plurality of transversely extending blades project downwardly and rearwardly and are positioned in a forward portion of the sole forward of the arch area. A second plurality of blades project downwardly and forwardly and are positioned rearwardly of the arch area of the shoe.

As an example of the invention, one or more blades can have a different wall thicknesses than one or more of the other blades. In an example, the wall thickness of the blades in the rear lateral portion is thicker than the center of the rear portion or medial side to allow more flex or bending of the blade after initial contact. As a further example, one or more blades can vary in thickness along the length of the blade in a direction transverse to the longitudinal axis of the shoe.

In a further example, one or more blades can vary in thickness in the longitudinal direction of the shoe either individually or vary in thickness with respect to an adjacent blade in the forward and/or rearward direction.

In a further example of the invention, an arch area of the sole includes blades that intersect each other. For example, blades located in the forefoot region and angled toward the back of the shoe intersect with blades located in the heel region that are angled toward the front of the shoe to form a crosshatch like pattern.

In a further example of the invention, the sole having blades facing rearwardly and forwardly is made in a single mold.

The downwardly protruding blades increase the surface area of the sole, thereby increasing traction. When used on hard surfaces, the blades collapse and moderate impact forces incurred by the wearer. Consequently, the blades allow the wearer to operate their foot with less effort and more comfort.

As should be apparent, the invention can provide a number of advantageous features and benefits. It is to be understood that in practicing the invention, an embodiment can be constructed to include one or more features or benefits of embodiments disclosed herein, but not others. Accordingly, it is to be understood that the preferred embodiments discussed herein are provided as examples and are not be construed as limiting, particularly since embodiments can be formed to practice the invention that do not include each of the features of the disclosed examples.

BRIEF DESCRIPTION OF THE DRAWINGS

The invention will be better understood from reading the description which follows and from examining the accompanying figures. These are provided solely as non-limiting examples of the invention. In the drawings.

DETAILED DESCRIPTION OF THE PREFERRED EMBODIMENTS

Figure 1:
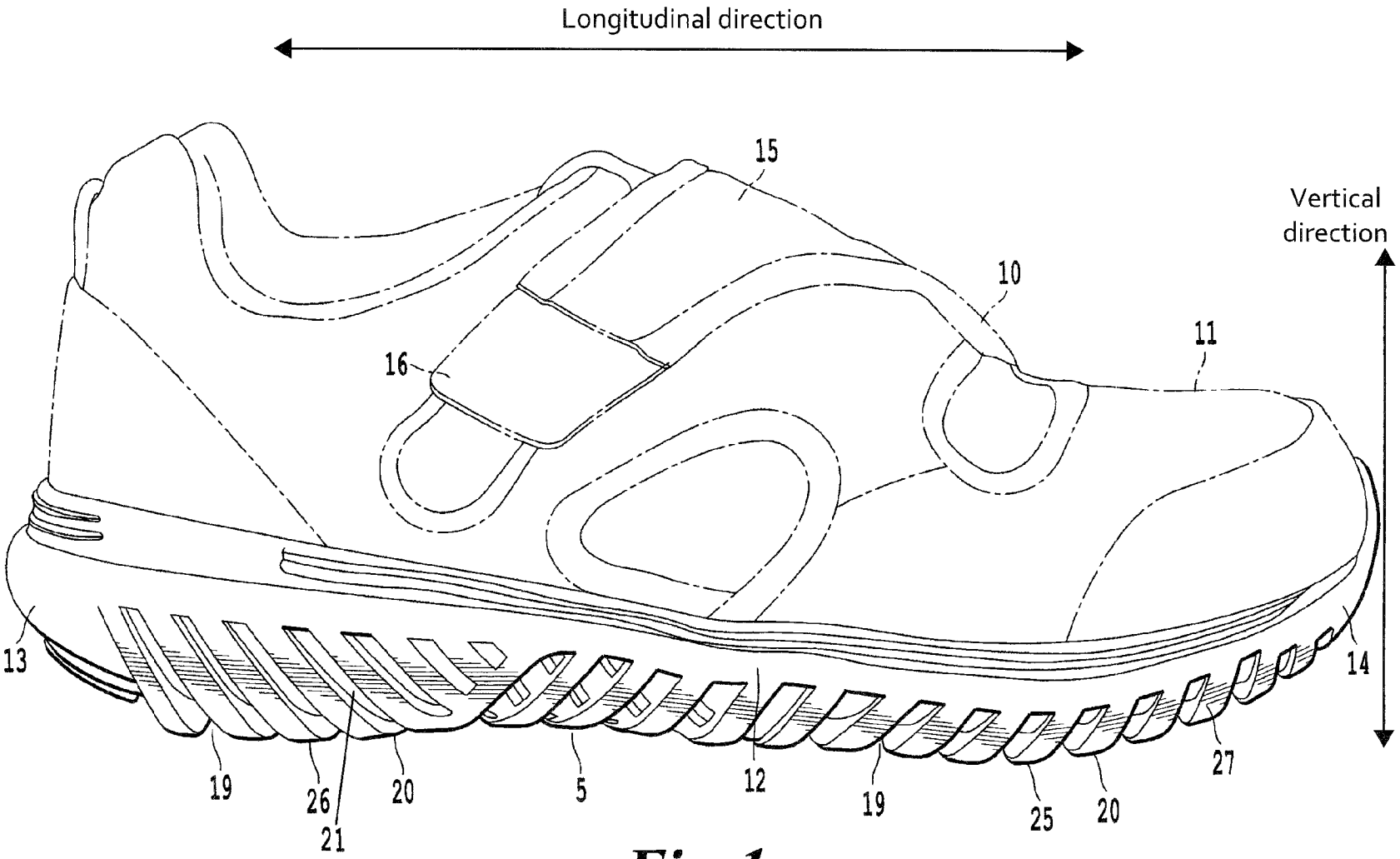
FIG. 1 is a side view of an athletic shoe according to an example of the invention.

Reference will now be made in detail to the present preferred embodiments of the invention, examples of which are illustrated in the accompanying drawings. Wherever possible, the same reference characters will be used throughout the drawings to refer to the same or like parts.

The present invention may be embodied in various forms. A preferred embodiment of an article of footwear, such as a shoe 10 is shown in FIG. 1. Shoe 10 includes an upper 11, a sole 12, a heel portion 13, a toe portion 14. The upper 11 of athletic shoe 10 is typically fabricated from for example, stitched fabric, leather, foam resin, canvas or other types of materials. Upper 11 is secured to an upper surface of sole 12 by stitching, adhesive or other suitable fastening means. Other configurations of upper 11 are also considered to be within the scope of the present invention. For example, upper 11 could be formed of a stretchable mesh material, such as footwear referred to as water shoes. Alternatively, upper 11 could be formed of a plurality of straps such that shoe 10 takes the form of a sandal.

In an embodiment of the invention, an instep 15 of upper 11 includes a securing device 16 to secure a wearer's foot within upper 11. The securing device 16 may be a hook and loop fastener as shown, however, laces, buckles, latches or any other suitable securing device to keep the wearers foot within upper is within the spirit and scope of the present invention.

The upper 11 may or may not include a midsole portion that is secured within upper 11 and can be made from for example, a foam or soft rubber type material. An embodiment of the invention includes a midsole that could be formed as an element of shoe 10, distinct from sole 12. A further embodiment of the invention includes a sole 12 that can provide the functions of a midsole, which include controlling over pronation, shielding the foot from excessive ground reaction forces, as well as advantageously utilizing the ground reaction forces.

Sole 12 is typically the ground contacting element of shoe 10, and is usually made from a durable, wear resistant material that can include texturing to improve traction. Sole 12 is preferably formed of a compressible material, which helps to absorb at least some of the impact forces encountered by sole 12 in use, and allows portions of sole 12 to flex and revert at least substantially back to a pre-impact position. As such, sole 12 can be made from foams, such as ethyl vinyl acetate (EVA), rubber, polyurethane, foamed rubber and non-foamed polymers. The sole 12 can be made from any desirable material suited to perform the functions of the sole and may be manufactured by injection molding, pouring, compression molding, or any other suitable manufacturing method.

Figure 2:
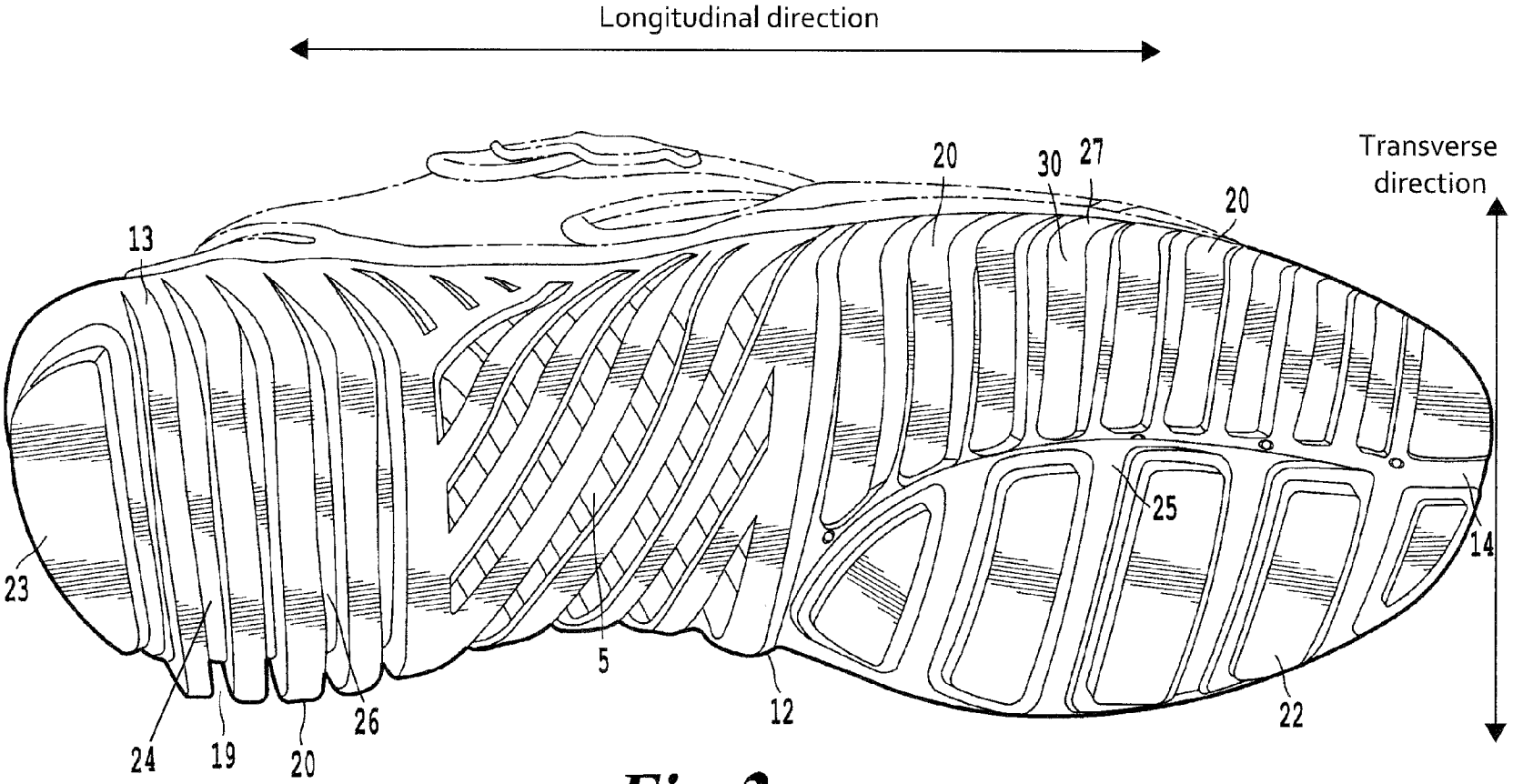
FIG. 2 is a bottom view of an athletic shoe according to an example of the invention.
Figure 3:
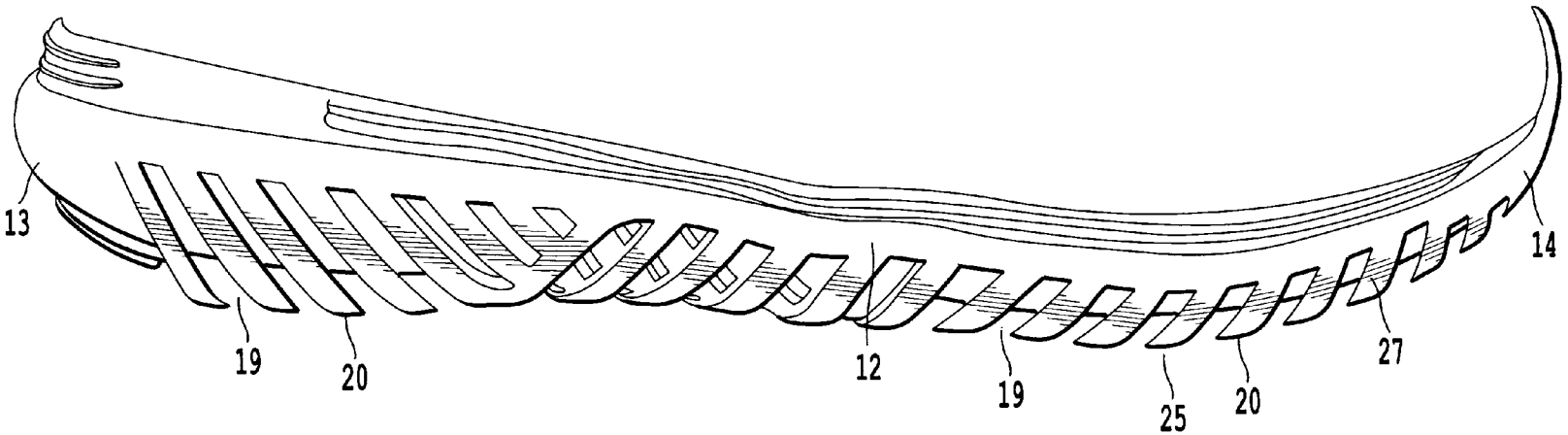
FIG. 3 is a side view of the toe region of an athletic shoe according to an example of the invention.

FIG. 1 is a side view of a shoe 10 according to an exemplary embodiment of the present invention that includes a sole 12 having a plurality of blades or protrusions 20 that are angled both forwardly and rearwardly. Sole 12 includes an exterior surface formed at least in part by a side portion 21 (shown, for example, in FIG. 1) and a bottom portion 24 (shown, for example, in FIG. 2). Unless otherwise stated, directional terms used herein, such as rearwardly, forwardly, inwardly, downwardly, upwardly, etc., refer to directions relative to shoe 10 itself. Shoe 10 is shown in FIG. 1 for example, to be disposed substantially horizontally, as it would be positioned on a horizontal surface when worn by a wearer. As an example shown in FIG. 1, rearwardly is toward heel portion 13, that is, to the left as seen in FIG. 1. Forwardly is toward toe portion 14, that is, to the right as seen in FIG. 1, and downwardly is toward the bottom of the page. As best shown in FIG. 2 with respect to an example of the invention, the blades 20 can extend transversely with respect to a longitudinal axis of the sole 12. In an example, blades 20 extend across the bottom of shoe 10 generally perpendicular to a longitudinal axis of sole 12.

As shown in the figures with respect to one or more exemplary embodiments of the invention, the plurality of blades or protrusions 20 project downwardly from sole 12 and define gaps or grooves 19 between adjacent blades 20. When the sole 12 comes into contact with a firm surface such as the ground surface while running or walking, the one or more protrusions or blades 20 formed as part of the sole 12 will bend or compress upon impact. In this way, the blades 20 help absorb the impact and shock to help lessen the forces acting on the body of the user.

In a preferred embodiment shown in FIG. 1, a plurality or set of blades 20 are disposed in a forward region 25 of sole 12 generally in the area where the toes and ball of the wearer's foot will be positioned. In an example, the plurality of blades 20 in the forward region 25 are angled rearwardly from a lower surface of sole 12. A plurality or set of blades 20 can also be positioned in the heel region 26 and can be angled forwardly with respect to a lower surface of sole 12. As discussed above, the blades 20 formed as part of the sole 12 can be made from a flexible material, such as EVA, rubber, or urethane. By having each of the plurality of blades 20 spaced apart from an adjacent blade by a groove 19, the blades 20 are able to compress and bend. Accordingly, blades 20 located in the forefoot region 25 will bend backward and blades 20 located in the heel region 26 will bend forward. As such, the blades 20 will bend in the direction of the angle of the blade.

The different angled surfaces of the blades 20 are designed to be oriented in a direction that can increase cushioning and comfort as well as enhance performance for the user. As such, embodiments of the invention including the rearwardly and forwardly facing blades 20, address the issues of cushioning and stability in both the heel strike area and the forefoot area with respect to applied force and shock during running and walking. In this way, a more comfortable and desirable running/walking experience is realized by the user due at least in part to the effects of the plurality of blades 20 formed with the sole 12.

As discussed in more detail below, other features can be adjusted at the time of manufacturing to obtain a desirable amount of deflection and/or compression, such as locating blades in one area of the sole 12 but not in other areas, using a particular type of material for the blades, varying a distance between each blade 20, and/or varying the width, thickness, and/or length of the blade 20.

It is within the spirit and scope of the present invention to have the blades 20 in the heel region 26 facing rearwardly and the blades 20 in the forefoot region 25 facing forwardly. In a further example of the invention, blades 20 in the heel region 26 and/or forefoot region 25 can have one or more blades 20 facing in both the forward and rearward directions. For example, a blade 20 in the forefoot region 25 can face rearwardly while an adjacent blade 20 located in the direction of the heel can be facing forwardly. In this way, the adjacent blades 20 can form a pyramid like formation that could compress upon impact and provide cushioning to the user.

Figure 4:
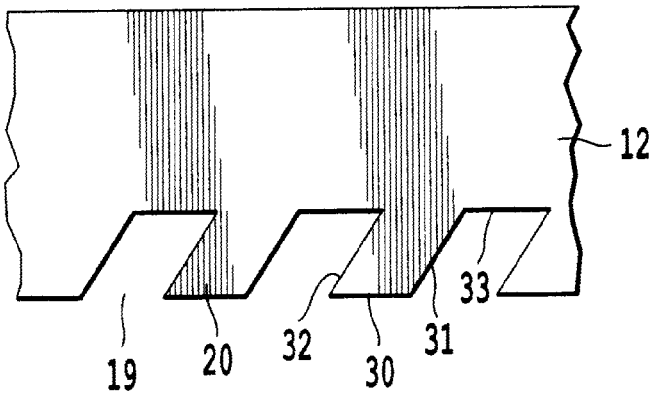
FIG. 4 is a side view of an example of the invention prior to the blades contacting a ground surface.

It should be appreciated that the blades 20 of one or more examples of the invention can be any desirable shape. As best shown for example in FIG. 4, the blades 20 prior to compression from use, have a ground engaging surface 30 and two opposite side surfaces (i.e., first and second side surfaces or "sides") 31,32. In an example of the invention, the sides 31, 32 are substantially parallel. Further, the ground engaging or third side surface 30 is generally parallel to a bottom surface 33 of sole 12, which is located at a top region of groove 19. Of course, sides 31, 32 of blades 20 in the forefoot region 25 and heel region 26 can be oriented in any desirable direction and therefore, do not have to be parallel. For example, a first side 31 can be substantially perpendicular to a bottom surface 33 of sole 12 (or top surface of groove 19) while the side 32 is angled with respect to bottom surface 33 in a rearward or forward direction, for example at approximately a 45 degree angle.

Figure 5:
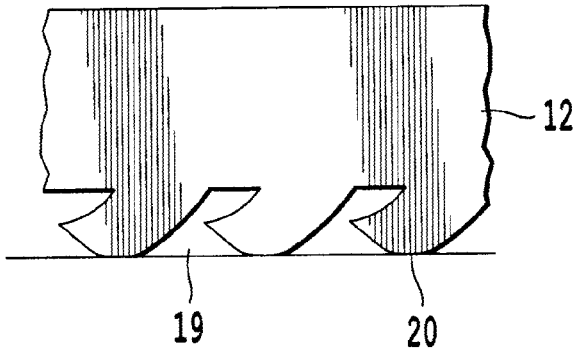
FIG. 5 is a side view of the blades during contact with a ground surface during use of the shoe according to an example of the invention.

Due to the positioning of the blades 20, the blades 20 provide a cushioning and a supportive feel to the user as well as enhancing performance of the shoe. As an example with respect to the blades 20 located in the forefoot region 25 shown in FIGS. 4 and 5, because the blades 20 are angled rearwardly, the blades 20 bend and compress and absorb the impact of the shoe contacting the ground. Additionally, when the shoe is lifted off of the ground surface, the restoring force of the blades 20 can help propel the user in the forward direction. Accordingly, due to the orientation of the blades 20, the sole 12 of the shoe 10 can reduce the friction created by the sole 12 when contacting the ground. That is, in an example, the blades 20 in the forefoot region are angled rearwardly and not angled in the direction of movement. Therefore the blades 20 do not dig into the ground surface when the user makes contact with the ground. If the blades 20 dug into the ground surface, an increase in friction would be created which would slow down the runner and decrease performance, in addition to decreasing stability due to the difference in contact between the blades 20 and the changing ground surface with each step.

As can be appreciated, the blades 20 will flex more or less depending on the weight of the user and whether the user is running or walking. In order to further affect the cushioning, stability and performance of the shoe, the blades 20 are spaced apart to allow enough compression and bending for cushioning but not too much to lessen support and performance provided by the shoe. In an example, the blades 20 can be spaced apart such that upon compression, a blade 20 will compress and bend and contact at least a portion of an adjacent blade 20. Additionally, in an example, at least a portion of a compressed blade 20 will contact an adjacent blade 20 and at least a portion of the compressed blade 20 will contact the bottom surface 33 of sole 12. With a portion of the compressed blade 20 contacting the bottom surface 33 as well as an adjacent blade 20, the blades 20 work in conjunction with each other and in conjunction with the remaining portions of the sole 12 to support and cushion the impact.

As can be appreciated, the blades 20 can be spaced apart at any desirable spacing in order to obtain desirable cushioning, support and performance while also reducing damage and wear on the blades 20. For example, one or more of the blades 20 can be spaced close together in order to reduce or prevent the blade 20 from contacting the bottom surface 33 of sole 12. In an alternate embodiment, the blades 20 can be spaced apart such that a bending of blade 20 will cause at least a substantial portion of the blade 20 to contact the bottom surface 33.

In an example of the invention, the spacing or width between adjacent blades 20 can be approximately the same size as the width of the blades 20. One or more embodiments of the invention provides for the spacing to be any desirable spacing to vary the performance of the shoe. In a further example, the spacing between two adjacent blades 20 can be a different spacing than between two adjacent blades 20 at a different location of the sole 12. In an even further embodiment, a height of one or more blades 20 can vary from a position near the upper to a ground contacting end 30 as desired. That is, one or more blades 20 can extend different distances away from surface 33.

Each blade 20 can be of uniform or variable thickness throughout its height. In an example, sides 31, 32 of the blades 20 can be parallel to each other and both be disposed at an angle, for example between 15 degrees and 90 degrees, with respect to the bottom surface 33. In an embodiment of the invention, the one or more blades are oriented at an angle from 25 to 75 degrees with respect to the bottom surface 33. In a further preferred embodiment the blades 20 are oriented approximately 45 degrees with respect to the bottom surface 33. It is within the spirit and scope of the present invention to provide any desirable angle for the blades 20. In a further example of the invention, one or more of the blades 20 can be provided at a first angle and one or more of the remaining blades 20 can be provided at one or more different angles.

As discussed above, blades 20 located in the forefoot region 25 of the shoe 10 can be angled rearwardly towards a heel region of the shoe 10. In an example of the invention, a blade 20 located at an end of the shoe 10 in the forefoot region 25 forms an angle with respect to the bottom surface 33 that is greater than or less than an angle formed by a blade 20 located closer to the heel region 26. In a further example, a blade 20 located at an end of the shoe 10 in the heel region 26 can form an angle with respect to the bottom surface that is greater than or less than an angle for a blade 20 located closer to the forefoot region 25. In an example, the angles formed by blades 20 are reduced for each blade 20 starting at the toe end and heading in the direction of the heel. Similarly, the angles formed by blades 20 are reduced for each blade 20 starting at a heel end and heading in the direction of the toe. In a further example, the angles can be increased heading from an end of the shoe 10 towards the middle of the shoe 10.

In an embodiment of the invention shown in FIG. 2, a plurality of blades 20 are adjacent to each other and located in the heel region 26 of shoe 10 and in the forefoot region 25 of shoe 10. In an embodiment, the blades 20 positioned in the heel and toe regions are positioned substantially transverse to the longitudinal direction of the shoe and extend from the outer lateral portion to the inner medial portion of sole 12. The blades 20 located in the forefoot region 25 of the sole 12 extend from an outer lateral side of the sole 12 partially across the width of the sole 12. In an embodiment, the blades 20 that only extend partially across the sole 12 can extend different distances across the width of the sole. In an example, the blades 20 positioned near the toe end of the shoe 10 are shorter than the blades located closer to the heel. Accordingly, it should be appreciated that embodiments of the invention envision the blades 20 at the heel and/or forefoot regions being able to extend either completely or partially across the sole 12 beginning at either the medial or lateral side of the sole.

As further shown in FIG. 2, in a region of the sole 12 having blades 20 that do not extend the entire width of the sole or having blades 20 only located in part of that region, additional tread can be provided different in size, shape, color, material, texture and/or orientation. For example, tread 22 is shown to have portions extending substantially perpendicular to the longitudinal axis. Further, the heel region has a tread region 23 different from the blades 20 to vary the comfort and/or performance of the shoe 10. The tread 22, 23 can be formed in the heel and/or toe region and can be oriented on a plane different from the bottom surface of the sole 12.

When the blades 20 extend across the width of sole 12 and reach a lateral and/or medial side of the sole 12, the side surface 27 of the blades 20 form the side surface of the sole 12. That is, the transition from the bottom surface 30 of the blades 20 to the side surface 27 is at least substantially continuous. Further, in an example of the invention, the grooves 19 extend from a bottom surface of the sole 12 to a side surface of the sole 12. As such, the grooves 19 are maintained in a position between adjacent blades 20 along the entire length of the blades 20. It should be appreciated that one or more of the grooves 19 can extend less than a complete length of the one or more blades 20. In an example of the invention with respect to a groove 19 extending only a part of the length of the blade 20, the adjacent blades 20 in the area without the groove 19 would be formed as a unitary piece. It should be appreciated that the unitary piece could be located at any position along the length of the blade 20, for example in the region of the side surface 27 or in a location approximately at the middle of the sole 12.

Further, as shown in FIG. 2, the blades 20 located in the heel region 26 are not located at the rearward end of the heel region 26. Accordingly, in one or more embodiments, the blades 20 can be located in the heel region of the sole 12 without being located in the entire heel region. Similarly, blades 20 located in the forefoot region do not have to be located along a complete length and/or width of the forefoot region 25.

It is also to be appreciated that although the embodiments illustrated and described herein show blades 20 located in the forward and rearward areas of the sole that extend substantially perpendicular to longitudinal axis, other orientations of blades 20 that project downwardly from sole 12 are considered to be within the scope of the invention. For example, sole 12 could include blades 20 oriented at an angle generally along the longitudinal axis of the shoe to an angle perpendicular to the longitudinal axis. The actual orientation of the one or more blades 20 depends at least in part on the type of performance desired for the shoe. A further example of the invention includes blades 20 such that the longitudinal axis of the blade 20 is non-planar. That is, an example provides for at least a portion of the blade 20 to be curved as the blade 20 extends between the medial and lateral sides of the shoe 10.

In a further example of the invention best shown in FIG. 2, an arch area 5 includes blades 20 intersecting each other. For example, blades 20 located in the forefoot region 25 and angled toward the back of the shoe intersect with blades 20 located in the heel region 26 and angled toward the front of the shoe. In this way, the blades 20 that intersect each other form a crosshatching like pattern in the arch area 5. In one example, the blades 20 of the crosshatching that are angled rearwardly with respect to the bottom surface 33 form a different angle with respect to the longitudinal axis of the shoe than the blades 20 of the forefoot region 25. Similarly, the blades 20 of the crosshatching that are angled forwardly with respect to the bottom surface 33 form a different angle with respect to the longitudinal axis of the shoe than the blades 20 of the heel region 26.

As discussed above, the amount of shock absorption each individual blade member 20 provides can be determined for example by either the firmness of the material or the thickness of each blade 20. In an example of the invention, one or more of the blades 20 can have a variable wall thickness in the lengthwise direction and/or the widthwise direction. In one embodiment, one or more blades 20 can have a greater thickness at the ends or sides which will reduce in thickness towards the top or middle of the blade 20. For example, one or more blades 20 can have a thicker wall thickness formed along the edges, which is tapered to a thinner wall thickness towards a middle. Providing the variable thickness according to this example allows for desirable deflection or compression upon initial contact with a firm surface.

Further, in one preferred embodiment, the lateral side of one or more blades 20 has thinner walls than the medial side so that upon contact with a ground surface during use, different shock absorption is provided from one side with respect to another side. For example, as the foot starts the rolling motion during running or walking, the sole will tend to firm up as it rotates towards the medial side to prevent over pronation.

Accordingly, one or more embodiments of the present invention do not need to rely on softer or thicker midsole foams to provide adequate shock absorption and support. The mechanical compressing, bending and flexing of the blades 20 provides increased shock absorption that in turn provides enhanced support, stability and performance.

In a further example of the invention, the sole, which includes blades facing rearwardly and forwardly, is made in a single mold in a single processing method step. In a preferred embodiment, the portion of the mold for making the blades 20 has smaller dimensions than the dimensions of the blades 20 after they are finally produced. In one example of the invention, the mold is approximately one third the size of the finally produced blade 20. In other examples of the invention, the mold is a size smaller or larger than one third of the finally produced blade 20. In an example of the invention, the material for making the blades is injected into the mold at high pressure.

Obviously, numerous modifications and variations of the present invention are possible in light of the above teachings. It is therefore to be understood that within the scope of the appended claims, the invention may be practiced otherwise than as specifically described herein.

The invention claimed is:

1. A shoe, comprising:

an upper;

a sole secured to the upper; and a plurality of protrusions projecting from both a bottom surface of the sole and from a lateral side surface of the sole, the plurality of protrusions located at least in a heel region of the shoe and a forefoot region of the shoe, wherein each of the plurality of protrusions are arranged to extend along the sole in a substantially transverse direction, wherein one or more of the plurality of protrusions located in the forefoot region of the shoe are designed to be angled rearwardly towards the heel region of the shoe such that the protrusions located in the forefoot region are bent rearwardly towards the heel region to absorb a load as the protrusions located in the forefoot region contact a ground surface, wherein one or more of the plurality of protrusions located in the heel region of the shoe are designed to be angled forwardly towards the forefoot region of the shoe such that the protrusions in the heel region are bent forwardly towards the forefoot region to absorb a load as the protrusions located in the heel region contact a ground surface, wherein at least one single continuous protrusion located in the heel region extends at least substantially an entire width of the sole from a lateral edge of the sole to a medial edge of the sole, wherein at least one protrusion located in the forefoot region extends from one of the lateral edge and the medial edge only partially across the width of the sole, wherein one or more of the plurality of protrusions include a first side surface and a second side surface substantially parallel to the first side surface, wherein the protrusions are designed such that a plane formed by a portion of the sole formed in gaps between adjacent protrusions is substantially parallel to a plane formed by a ground engaging surface of an adjacent protrusion, wherein the heel region and the forefoot region are separated by an arch region containing protrusions that intersect each other to overlap and form a crosshatching pattern, and wherein at least one of the protrusions in the arch region continuously extends at least substantially an entire width of the sole from a lateral edge of the sole to a medial edge of the sole.

2. The shoe according to claim 1, wherein an angle formed by one or more of the protrusions with respect to a longitudinal direction of the sole is in a range of 35 degrees to 75 degrees.

3. The shoe according to claim 1, wherein the plurality of protrusions are spaced apart thereby defining gaps between adjacent protrusions, wherein a width of each gap in at least one of the forefoot region and heel region varies between adjacent protrusions.

4. The outsole according to claim 3, wherein the width of the gaps in the forefoot region between protrusions at a toe end is larger than the width of the gaps for protrusions in the forefoot region located closer to a middle of the sole.

5. The shoe according to claim 1, wherein the plurality of protrusions are made of a compressible material.

6. The shoe according to claim 1, wherein the arch region contains a first set of protrusions angled forwardly and a second set of protrusions angled rearwardly.

7. The shoe according to claim 1, wherein a thickness of one or more of the plurality of protrusions varies along a length of the protrusion in a vertical direction of the shoe.

8. The shoe according to claim 1, wherein a thickness of one or more of the plurality of protrusions in at least one of the heel and forefoot region varies from one protrusion to an adjacent protrusion.

9. The shoe according to claim 7, wherein the thickness of the protrusion is greater at a portion of the protrusion adjacent the medial side of the shoe than in an area adjacent a lateral side of the shoe.

10. The shoe according to claim 1, wherein the plurality of protrusions formed in the forefoot region are angled rearwardly at an angle in a range of 25 to 85 degrees with respect to a bottom surface of the sole, and the plurality of protrusions formed in the heel region are angled forwardly at an angle in a range of 25 to 85 degrees with respect to a bottom surface of the sole.

11. The shoe according to claim 10, wherein in at least one of the forefoot and heel regions, an angle formed by one or more of the plurality of protrusions is different with respect to an adjacent protrusion.

12. The shoe according to claim 1, wherein gaps formed between adjacent protrusions also extend along the side surface of the sole.

13. The shoe according to claim 1, wherein one or more of the plurality of protrusions in the forefoot region are formed of a first material and one or more of the plurality of protrusions in the heel region are formed of a second material different from the first material.

14. The shoe according to claim 5, wherein the compressible material is ethyl vinyl acetate.

15. The shoe according to claim 14, wherein the sole includes a least one tread region different from the heel and forefoot protrusion regions, and wherein at least one of the tread regions is made from a material different from the protrusions.

16. An article of footwear including a sole, the sole comprising:

an exterior surface having a bottom portion, a side portion extending upward from the bottom portion, and a plurality of protrusions projecting outward from both the side portion and the bottom portion, wherein each of the protrusions are arranged to extend along the sole in a substantially transverse direction, wherein each of the protrusions include a first side surface, a second side surface substantially parallel to the first side surface, and a third side surface that connects the first side surface to the second side surface, a portion of the third side surface being designed to contact the ground, wherein the portion of the third side surface designed to contact the ground is in the shape of a flat plane defined by the longitudinal and transverse directions of the sole, wherein a first set of the protrusions are located in a forefoot region of the sole and are angled towards a first longitudinal direction, the first set of protrusions being designed such that the protrusions are bent in the first longitudinal direction to absorb a load as the protrusions contact a ground surface, wherein a second set of the protrusions are located in a heel region of the sole and are angled towards the opposite longitudinal direction, the second set of protrusions being designed such that the protrusions are bent in the second longitudinal direction to absorb a load as the protrusions contact a ground surface, wherein the first set of protrusions are angled rearwardly towards the heel region of the sole, and the second set of protrusions are angled forwardly towards the forefoot region of the sole, wherein at least one protrusion of the first set of protrusions extends only partially across the width of the sole, wherein at least one single continuous protrusion of the second set of protrusions extends substantially across the entire width of the sole, wherein the heel region and the forefoot region are separated by an arch region containing protrusions that intersect each other to overlap and form a crosshatching pattern, and wherein at least one of the protrusions in the arch region continuously extends at least substantially an entire width of the sole from a lateral edge of the sole to a medial edge of the sole.

* * * * *